US006213729B1

(12) United States Patent
Fassbender et al.

(10) Patent No.: US 6,213,729 B1
(45) Date of Patent: Apr. 10, 2001

(54) SUCTION-THROTTLED PUMP

(75) Inventors: Axel Fassbender, Offenbach; Hans-Juergen Lauth, Neu Anspach, both of (DE)

(73) Assignee: Luk Fahrzeung-Hydraulik GmbH & Co., KG (DE)

( * ) Notice: Subject to any disclaimer, the term of this patent is extended or adjusted under 35 U.S.C. 154(b) by 0 days.

(21) Appl. No.: 09/041,263

(22) Filed: Mar. 12, 1998

(30) Foreign Application Priority Data

Mar. 13, 1997 (DE) ..... 197 10 379

(51) Int. Cl.[7] ..... F04B 1/04; F04B 27/04
(52) U.S. Cl. ..... 417/273; 417/295; 417/441
(58) Field of Search ..... 417/273, 295, 417/441

(56) References Cited

U.S. PATENT DOCUMENTS

| | | | | |
|---|---|---|---|---|
| 1,694,329 | * | 12/1928 | Le Bus | 428/432 |
| 2,546,583 | * | 3/1951 | Born | 91/482 |
| 3,151,569 | | 10/1964 | Muller | 103/173 |
| 3,418,937 | | 12/1968 | Cardillo et al. | 103/39 |
| 3,434,428 | | 3/1969 | Liles | 103/40 |
| 3,790,307 | | 2/1974 | Aldinger . | |
| 4,065,229 | | 12/1977 | Black | 417/270 |
| 4,094,617 | * | 6/1978 | Shibuya | 417/295 |
| 4,490,971 | * | 1/1985 | Hedelin | 60/39.63 |
| 4,643,639 | * | 2/1987 | Caine | 415/415 |
| 5,156,531 | | 10/1992 | Schmid et al. | 417/295 |
| 5,167,493 | | 12/1992 | Kobari | 417/273 |
| 5,277,553 | * | 1/1994 | Stolpp | 417/273 |
| 5,873,706 | * | 2/1999 | Kawabata | 417/295 |

FOREIGN PATENT DOCUMENTS

| | | |
|---|---|---|
| 8614289 | 11/1987 | (DE) . |
| 2207955 | 2/1989 | (GB) . |
| 9102156 | 2/1991 | (WO) . |

* cited by examiner

*Primary Examiner*—Charles G. Freay
*Assistant Examiner*—David J. Torrente
(74) *Attorney, Agent, or Firm*—Ostrolenk, Faber, Gerb & Soffen, LLP

(57) ABSTRACT

A suction-throttled pump, comprising at least one displacement body for the delivery of a medium and movable in a delivery chamber, into which opens at least one inflow channel extending between the delivery chamber and a suction chamber, and comprising a suction control valve, the pump being characterised in that the suction control valve (33; 33'; 33") co-operates directly with the inflow channel (25; 25') and is arranged at the end thereof facing the suction chamber (27).

14 Claims, 4 Drawing Sheets

SUCTION-THROTTLED PUMP

BACKGROUND OF THE INVENTION

The invention relates to a suction-throttled pump comprising at least one displacement body for the delivery of a medium in accordance with the preamble of claim 1.

Suction-throttled pumps are known. They are used in motor vehicles, for example, and operated at varying speeds. The flow of medium required by the pump consumer is limited. At high pump speeds, the delivery rate of the medium would be too high. Therefore, a throttle valve, also referred to as a suction control valve, is provided in the suction region of the pump, i.e. between the pump and a reservoir or tank, and limits the quantity of medium sucked in. If pumps of this type are used in connection with a liquid medium, for example hydraulic oil, the static pressure in the suction region of the pump can drop below atmospheric pressure, with the result that foam forms. The dynamic properties of the pump are permanently impaired by the foam-containing oil. Furthermore, a pump displacer, which delivers the medium, is not uniformly filled on account of the foam, resulting in a non-uniform delivery rate. Moreover, the operating noises of the pump increase considerably.

SUMMARY OF THE INVENTION

Therefore, the object of the invention is to provide a suction-throttled pump of the aforesaid type which does not have these disadvantages.

A suction-throttled pump with features including at least one displacement body movable in a working chamber for delivery of a fluid medium, a suction chamber, an inflow channel between the delivery chamber and the suction chamber, and a suction control valve for the inflow channel is proposed in order to achieve this object. The pump is characterized in that the suction control valve co-operates directly with an inflow channel opening into a working chamber of a displacement body and extending between a suction chamber and this working chamber. The suction control valve is arranged at the end of the inflow channel facing the suction chamber so that there is only a minimal volume of oil in which the static pressure can drop below atmospheric pressure. Even if foam forms here, the foam quantities are so small that in practice they no longer have a detrimental effect on the dynamic properties, the pumping behavior or the noise generation of the pump.

A preferred embodiment of the pump comprises a plurality of valve bodies each having an inflow channel opening into the suction chamber. The suction control valve is characterized by a valve body associated with all the inflow channels. This produces a very simple pump design with optimum operating behavior.

A further embodiment of the pump is characterized in that the suction control valve is adjustable, consequently, the working rate of the pump is easily controllable.

Another embodiment of the pump comprises a cylinder block in which the displacement body or bodies are arranged. The cylinder block is characterized by a groove having an annular surface into which the inflow channel or channels open. The valve body of the suction control valve co-operates with this annular surface. This produces a very simple, but effective design which is inexpensive to manufacture and is distinguished by the fact that no more than a very small quantity of foam-containing oil is produced.

Other features and advantages of the present invention will become apparent from the following description of the invention which refers to the accompanying drawings.

DETAILED DESCRIPTION OF THE INVENTION

The suction-throttled pump according to the invention comprises at least one displacement body for the working of a medium. The structure of the pump is irrelevant to the inventive solution described here. Consequently, the pump may be designed as an axial or radial piston pump. It is also possible to form the pump as a gerotor pump.

The following is based, purely by way of example, on a radial piston pump comprising four displacement bodies and provided for the delivery of a liquid medium.

Figure 1:
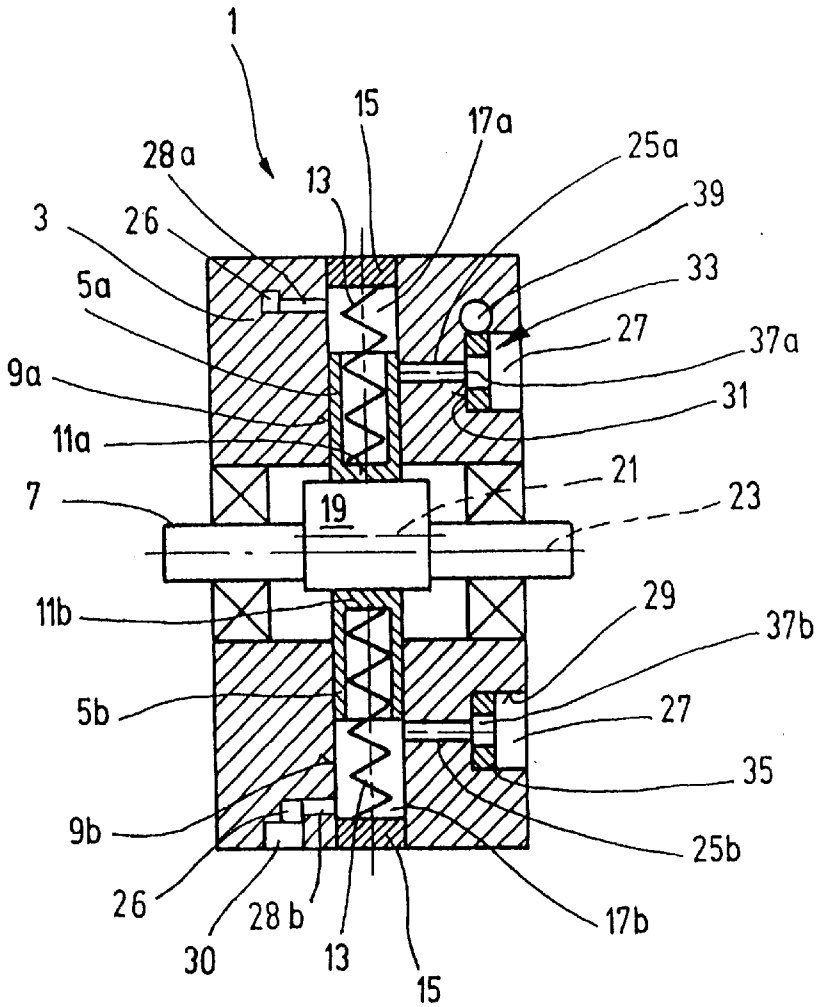
FIG. 1 shows a partial longitudinal section through a first embodiment of a pump.

FIG. 1 shows a partial longitudinal section through the interior of a pump 1 formed as a radial piston pump and comprising a cylinder block 3 in which at least one, in this case a plurality of displacement bodies are movably mounted. An upper displacement body 5*a* and a lower displacement body 5*b* are shown in longitudinal section. The displacement bodies, designated in short in the following by the reference numeral 5, are housed in bores 9*a*, 9*b* extending radially to a drive shaft 7 and designated in short in the following by the reference numeral 9. The displacement bodies 5 are cylindrical and to a certain extent cup-shaped, i.e. hollow inside. The base 11*a*, 11*b*—11 in short in the following—faces the drive shaft 7, and a resilient member, formed as a helical spring 13, is inserted into the interior of the displacement bodies 5 and is supported on a cover 15 closing the radially outer end of the bore 9. The space enclosed by the displacement bodies 5 and the covers 15 forms the working chamber 17*a*, 17*b*, designated in short in the following by the reference numeral 17. The base 11 of the displacement bodies 5 co-operates with a cam 19 provided on the drive shaft 7, the center axis 21 of the cam 19 being offset in relation to the rotation axis 23 of the drive shaft 7 so that, on rotation of the drive shaft 7, the displacement bodies 5 are forced back into the bores 9 against the force of the helical spring 13 by varying amounts. In the representation shown here, the upper displacement body 5*a* is at top dead center, i.e. in a position in which the base 11*a* is at the maximum distance from the rotation axis 23. In contrast, the displacement body 5*b* is at bottom dead center, in which its base 11*b* is at its shortest distance from the rotation axis 23. As a result of the reciprocating movement of the displacement bodies 5, the working chamber 17 becomes alternately larger and smaller, resulting in suction of the medium to be delivered or expulsion thereof.

A feed channel 25*a*, extending parallel with the rotation axis 23, opens into the working chamber 17*a*. In the same way, an inflow channel 25*b*, extending parallel with the rotation axis 23, is associated with the working chamber 17*b*. The medium to be delivered can pass from a suction chamber 27 into the working chamber 17 via the inflow channel 25. The suction chamber is formed here as an annular groove 29, the base of which faces the displacement bodies 5 and forms an annular surface 31.

An annular discharge chamber 26 communicates with working chambers 17*a* and 17*b* by way of respective discharge passages 28*a* and 28*b*. Conventional one-way discharge valves in each passage (not shown) prevent backflow into the working chambers during the suction cycles. A discharge opening 30 communicates with discharge chamber 26.

The inflow channels 25 communicating with the suction chambers 17 open into the suction chamber 27. It can be seen from the drawing that a suction control valve 33 co-operates directly with the inflow channels 25 and comprises a valve body 35. The latter can comprise a plurality of ring segments or be formed as a continuous annular disc which rests on the annular surface 31 and thereby controls all the inflow channels 25 opening into the suction chamber 27. Valve openings, designated in short in the following as openings 37, are provided in the valve body 35, one opening 37 preferably being associated with each mouth of an inflow channel 25 and covering the mouth to a varying extent.

The suction control valve, arranged upstream of the working chamber 17 in the immediate vicinity thereof, is adjustable and co-operates with an operating device 39 which can produce a rotation movement of the disc-shaped valve body 35 so that the openings 37 cover the mouths of the inflow channels 25 opening into the suction chamber 27 to a varying extent.

Figure 2:
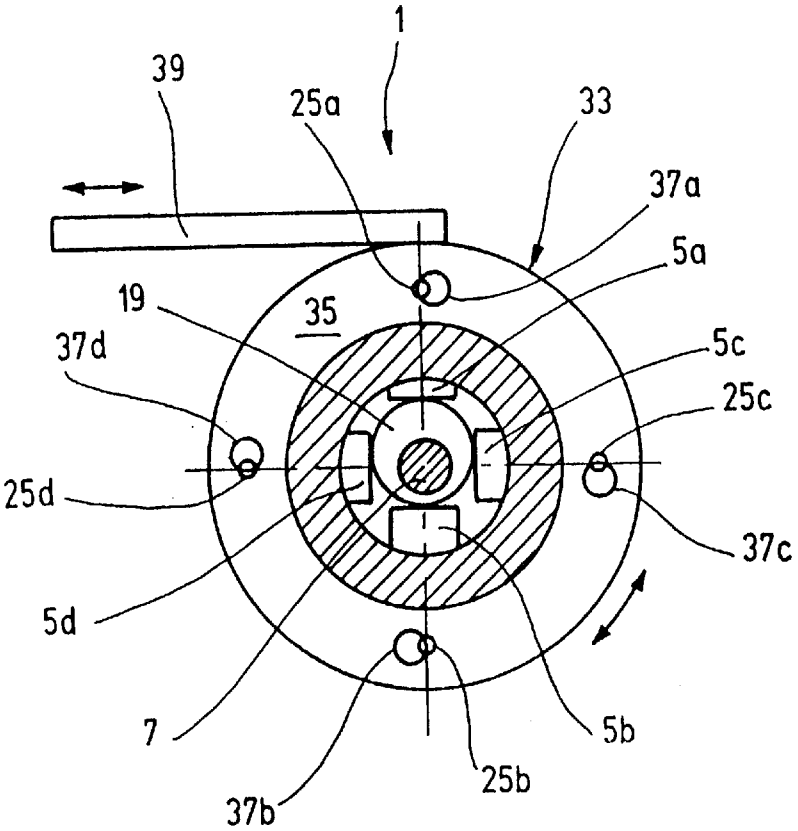
FIG. 2 shows a view of the suction control valve of the pump shown in FIG. 1.

FIG. 2 shows a view of the suction control valve 33. The valve body 35, formed as a continuous annular disc, is clearly identifiable and has four openings 37*a*, 37*b*, 37*c* and 37*d* designated in short in the following by the reference numeral 37. FIG. 2 also shows that the pump 1 has four displacement bodies 5*a* to 5*d* which co-operate with the cam mounted on the drive shaft 7 and form variable working chambers 17, into which the medium to be delivered passes via inflow channels 25*a* to 25*d*. The mouths of the inflow channels 25 are shown as circles which can be covered by the valve body 35, the openings 37 uncovering the mouths of the inflow channels 25 to a varying extent. A reciprocating movement—indicated by a double arrow—of the operating device 39, of which only an operating rod is shown and which substantially executes a translatory movement extending in the horizontal direction, produces a reciprocating rotation movement of the valve body 35—indicated by a double arrow—so that the openings 37 thereof uncover the mouths of the inflow channels 25 to a varying extent. The movably constructed valve body 35 thus forms an adjustable suction control valve 33.

Figure 3:
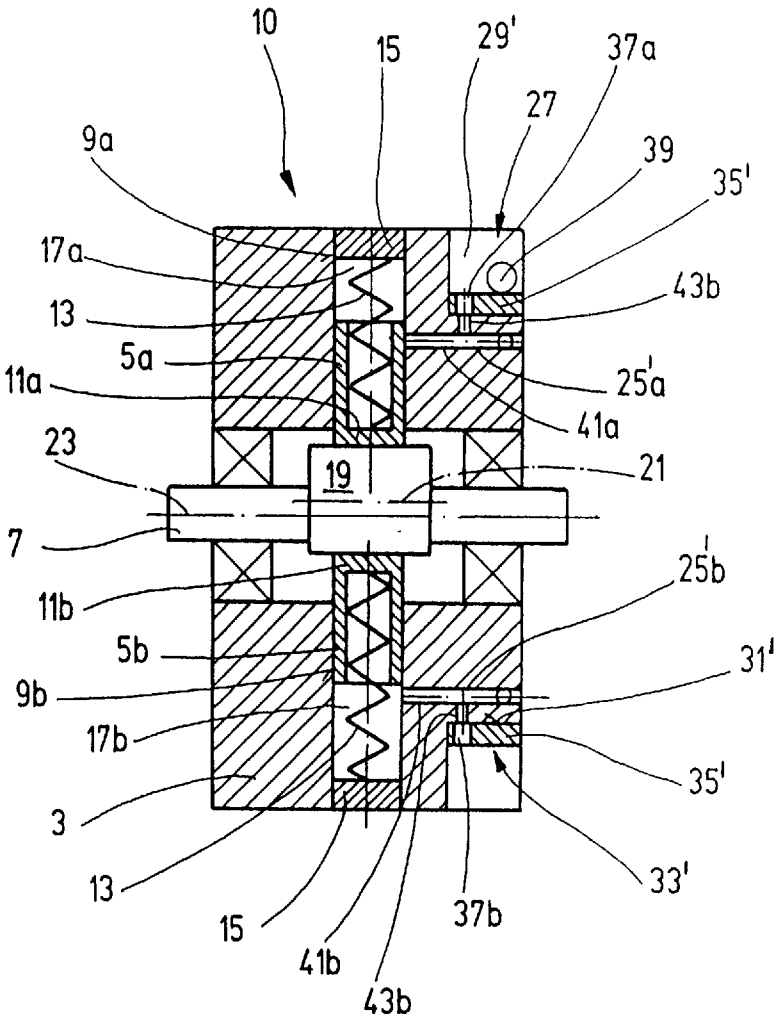
FIG. 3 shows a partial longitudinal section through a second embodiment of a pump.

FIG. 3 shows a partial longitudinal section through a modified embodiment of a pump 10. Parts corresponding to those in FIG. 1 are provided with the same reference numerals. In this respect, reference is made to the description relating to FIG. 1.

In the following, only the differences between the pump 10 and the pump 1 described with reference to FIG. 1 will be considered: the cylinder block 3 of the pump 10 has an annular groove 29' in which a suction control valve 33' is arranged. The latter comprises a valve body 35' formed as a cylindrical ring or at least comprising cylindrical ring segments. Openings 37, also designated as valve openings, are provided in the valve body 35 and are associated with inflow channels 25'*a* and 25'*b* comprising a channel portion 41 extending parallel with the rotation axis 23 of the drive shaft 7, and a channel portion 43 intersecting the channel portion 41, but extending perpendicularly thereto. The medium to be delivered can pass from the groove 29', forming the suction chamber 27, into the working chambers 17 or 17*a*, 17*b* through the in effect angular inflow channels 25. The base of the groove 29' forms a cylindrical annular surface 31' arranged concentrically with the rotation axis 23, whereas the annular surface 31 shown in FIG. 1 lies in a plane perpendicular to the rotation axis 23. The valve body 35' rests on this annular surface 31'. In this case too, it co-operates with an operating device 39 so that the displaceably formed valve body 35' can be adjusted. With a rotational reciprocating movement of the valve body 35', the openings 37 thereof overlap the mouths of the inflow channels opening into the suction chamber 27, or more precisely the mouths of their radially extending channel portions 43. The suction control valve 33' can thus control the working of the medium fed into the working chambers 17; in this case too, there are only very small residual quantities between the suction control valve 33' and the working chambers 17, and thus only extremely small quantities of foam can be formed.

Figure 4:
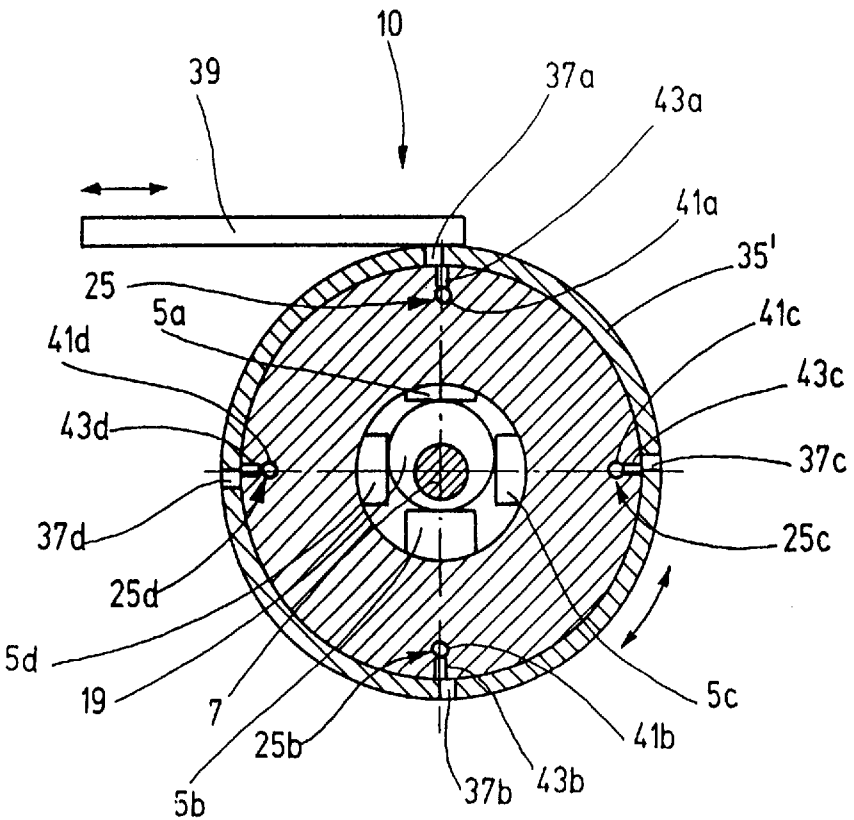
FIG. 4 shows a cross-section through the pump shown in FIG. 3.

FIG. 4 shows a cross-section through the pump 10 described with reference to FIG. 3. Like parts are provided with like reference numerals; in this respect, reference is made to the description relating to FIGS. 3 and 1.

The representation in FIG. 4 shows the inflow channels 25, or more particularly their channel portions 41*a* to 41*d* and 43*a* to 43*d* extending axially and radially respectively. The sectional representation also shows that the openings 37*a* to 37*d* cover the radially outer mouths of the radially extending channel portions 43*a* to 43*d* to a varying extent, a translatory movement of the adjusting device 39—indicated by a double arrow—producing a rotational reciprocating movement of the valve body 35', likewise indicated by a double arrow.

Figure 5:
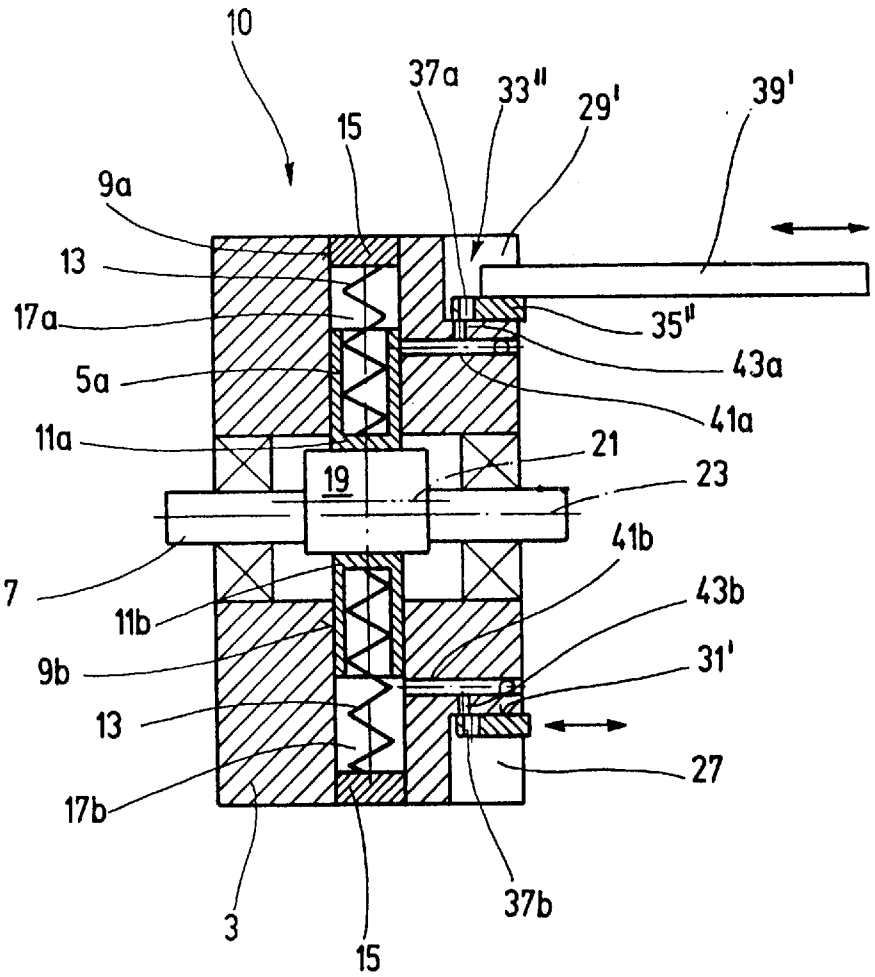
FIG. 5 shows a partial longitudinal section through a pump with a suction control valve modified in relation to FIG. 3.

Finally, FIG. 5 shows a partial longitudinal section through a pump 10, wherein the suction control valve 33" has been modified in relation to the suction control valve 33' shown in FIG. 3 in that an operating device 39' does not produce a rotation movement of the valve body 35", but a translatory reciprocating movement indicated by a double arrow both on the operating device 39' and on the valve body 35". In the case of a translatory movement, the valve body 35" is not rotated, but pushed into the groove 29' to a varying extent so that the valve body 35" is displaced on the annular surface 31' of the groove 29' in a direction parallel with the rotation axis 23. The mouths of the radially extending channel portions 43*a*, 43*b*, etc. are covered to a varying extent by the openings 37*a*, 37*b*, etc., thus producing a variable throttle cross-section. It should also be pointed out here that a translatory movement can also be superposed by a rotation movement in order to produce a variable throttle cross-section.

It can easily be seen that the suction control valve can also be provided in the region of the cover 15 if the radial piston pump 10, described with reference to FIGS. 3 to 5, is designed accordingly, in which case a suction chamber 27 extending round the outside,of the cylinder block 3 would be provided. However, for the operation of the suction control valve, it would also be ensured here that only a very small amount of oil forms between the working chamber 17 and the suction control valve and only extremely small quantities of foam can form.

Figure 6:
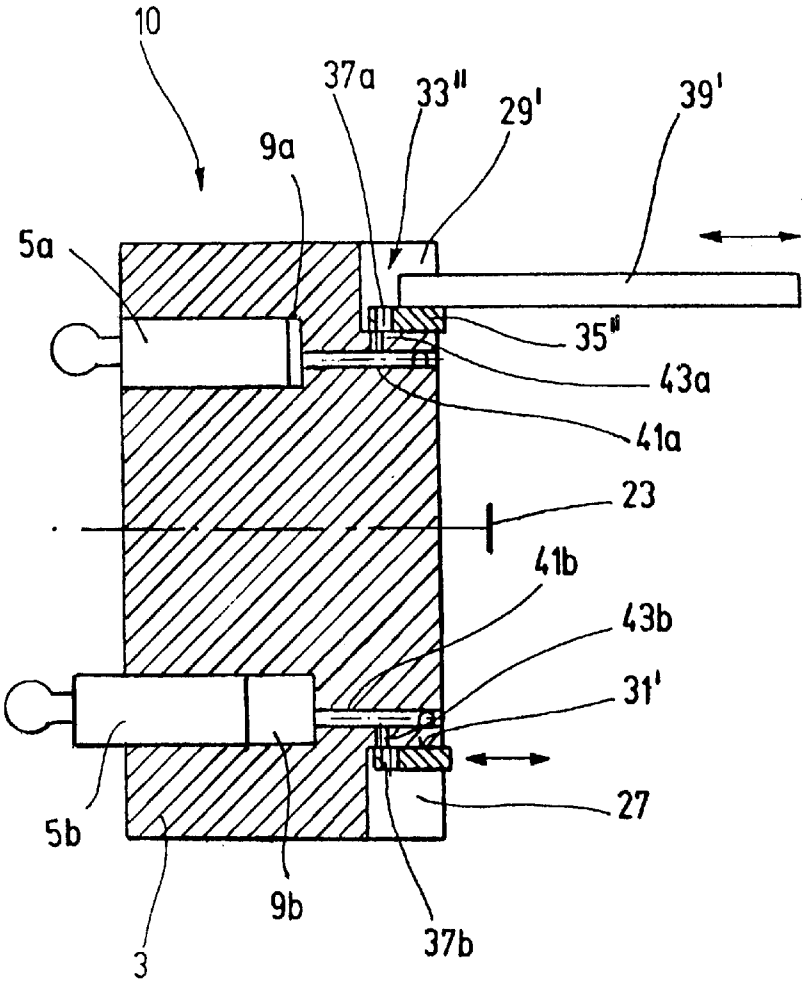
FIG. 6 shows a further embodiment of the invention comprised of an axial piston pump.

FIG. 6 illustrates the application of the suction control valve described shown in FIG. 5 for use in connection with pumps having displacement bodies which extend not radially, but axially, i.e. parallel with the rotation axis 23, thereby producing axial piston pumps 10'. These may also have a plurality of displacement bodies 5*a* and 5*b*, reciprocating in respective bores 9*a* and 9*b*. The axial reciprocal motion may be achieved by use of a conventional swash plate mechanism which cooperates with spherical projections 40*a* and 40*b* on displacement bodies 5*a* and 5*b*, respectively. Naturally, it is possible to use a suction control valve of the type described here together with a gerotor pump.

In all cases, it can be seen that the pump is of very compact construction and that the suction control valve co-operates directly with the inflow channels opening into the working chambers. For the design of the suction control valve, it is possible for the valve body to co-operate with a plurality of mouths of the inflow channels, for example to use ring segments as valve bodies and preferably to construct these so as to be movable. However, the structure of the pumps is particularly simple if the valve body is formed as a continuous disc-shaped or cylindrical annular member. In this case, all the inflow channels can be controlled by one operating device.

The structure of the suction control valve described here produces particularly good dynamics of the pump, i.e. it responds very quickly to a change in the position of the valve body. Moreover, the working chambers are filled better and more uniformly, as there are only extremely small amounts of foam to affect the behavior of the pump. This also results in better and more uniform pump working. In addition, noise generation is substantially reduced.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A suction-throttled pump comprising:

a pump body, a working chamber in the pump body;

a displacement body located in the working chamber and being movable therein to increase and decrease the volume of the working chamber;

a suction chamber in the pump body separated from the working chamber;

an inflow channel connecting the suction chamber and the working chamber; the suction chamber is comprised of an annular groove in the pump body, the groove having one wall having a port therein aligned with the inflow channel and a suction control valve between the inflow channel and the suction chamber, the suction control valve including:

a valve member; the valve member including an opening therein permitting communication between the suction chamber and the inflow channel; the valve member being non-rotationally translatable to control the passage of fluid from the suction chamber to the inflow channel to vary the position of the valve opening relative to the inflow channel, and to vary the alignment of the valve body opening relative to the port.

2. A pump as claimed in claim 1, in which the port is located in the radially inner wall of the suction chamber.

3. A pump as claimed in claim 2 in which the valve member is comprised of an axially extending ring positioned adjacent to the radially inner wall of the suction chamber with the valve opening in circumferential alignment with the port in the suction chamber wall, and with the ring axially slidable to vary the alignment of the valve opening relative to the port.

4. A pump as claimed in claim 1 in which the valve member is comprised of an axially extending ring positioned adjacent to the wall of the suction chamber having the port therein, with the valve opening in circumferential alignment with the port, and with the ring axially slidable to vary the alignment of the valve opening relative to the port.

5. A suction-throttled pump comprising:

a pump body, a working chamber in the pump body;

a displacement body located in the working chamber and being movable therein to increase and decrease the volume of the working chamber;

a suction chamber in the pump body separated from the working chamber;

an inflow channel connecting the suction chamber and the working chamber; and a suction control valve between the inflow channel and the suction chamber, the suction control valve including:

a valve member; the valve member permitting communication between the suction chamber and the inflow channel; the valve member being non-rotationally translatable to control the passage of fluid from the suction chamber to the inflow channel;

at least one additional working chamber in the pump body, all of the working chambers being spaced apart from each other;

at least one additional displacement body, each of the displacement bodies being located in one of the working chambers and being movable therein to increase and decrease the volume of the working chamber;

at least one additional inflow channel, each of which connects the suction chamber to one of the working chambers; and the valve member including a plurality of value openings permitting communication between the suction chamber and respective ones of the inflow channels, the valve member being non-rotationally translatable to vary the fluid flow between the suction chamber and the inflow channels and to vary the positioning of the valve openings relative to the inflow channels.

6. A pump as claimed in claim 5, in which:

the suction chamber is comprised of an annular groove in the pump body, the groove having one wall having a plurality of spaced ports therein aligned with the ends of the respective inflow channel; and in which the valve body is non-rotationally translatable to vary the alignment of the respective valve body openings relative to the ports.

7. A pump as claimed in claim 6 or, in which the ports are located in the radially inner wall of the suction chamber.

8. A pump as claimed in claim 7 in which the valve member is comprised of an axially extending ring positioned adjacent to the radially inner wall of the suction chamber with the valve openings in circumferential alignment with respective ports in the suction chamber wall, and with the ring axially slidable to vary the alignment of the valve openings relative to the respective ports in the suction chamber wall.

9. A pump as claimed in claim 6 in which the valve member is comprised of an axially extending ring positioned adjacent to the wall of the suction chamber having the ports therein, with the valve openings in circumferential alignment with respective ones of the ports, and with the ring axially slidable to vary the alignment of the valve openings relative the respective ports.

10. A pump as claimed in claim 5 wherein:

the pump body comprises a cylinder block, the working chambers and the displacement bodies being disposed in the cylinder block in an annular, radially outwardly directed array; and in which to the suction chamber is comprised of a groove formed in the cylinder block including an annular surface having openings therein through which the inflow channels communicate with the suction chamber; and in which the valve member is positioned adjacent to the annular surface.

11. A pump as claimed in claim 5, in which the pump is a radial piston pump and in which the displacement bodies are pistons.

12. The pump as claimed in claim 5, in which the pump is an axial piston pump.

13. A pump as claimed in claim 5, in which a plurality of openings in the valve member and respectively positioned adjacent to one end of each of the inflow channels; and the valve member is non-rotationally translatable to vary the positioning of the valve openings relative to the respective ends of the inflow channels.

14. A pump as claimed claim 1, in which the opening in the valve member is positioned adjacent to one end of the inflow channel; and the valve member is non-rotationally translatable to vary the position of the valve opening relative to the one end of the inflow channel.

* * * * *